US006236288B1

(12) United States Patent
Tsujiguchi

(10) Patent No.: US 6,236,288 B1
(45) **Date of Patent: *May 22, 2001**

(54) DIELECTRIC FILTER HAVING AT LEAST ONE STEPPED RESONATOR HOLE WITH A RECESSED OR PROTRUDING PORTION, THE STEPPED RESONATOR HOLE EXTENDING FROM A MOUNTING SURFACE

(75) Inventor: Tatsuya Tsujiguchi, Kanazawa (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,786

(22) Filed: Mar. 31, 1998

(30) Foreign Application Priority Data

Mar. 31, 1997 (JP) ..... 9-079919
Feb. 13, 1998 (JP) ..... 10-031165

(51) Int. Cl.[7] ..... H01P 1/213; H01P 1/202; H01P 7/04

(52) U.S. Cl. ..... 333/134; 333/206; 333/222

(58) Field of Search ..... 333/202, 206, 333/207, 222, 126, 134, 129

(56) References Cited

U.S. PATENT DOCUMENTS 5,250,916 * 10/1993 Zakman ..... 333/134 X
5,374,906 12/1994 Noguchi et al. ..... 333/134
5,489,882 * 2/1996 Ueno ..... 333/206
5,517,163 * 5/1996 Sagawa et al. ..... 333/206 X
5,686,873 * 11/1997 Tada et al. ..... 333/206 X
5,764,118 * 6/1998 Saito et al. ..... 333/222 X
5,793,267 * 8/1998 Tada et al. ..... 333/206 X
5,864,265 * 1/1999 Ballance et al. ..... 333/134 X
5,945,896 * 8/1999 Miyamoto ..... 333/206
6,057,746 * 5/2000 Ito ..... 333/206 X

FOREIGN PATENT DOCUMENTS 0654842 5/1995 (EP) .
1123501 5/1989 (JP) .
2-92001 * 3/1990 (JP) ..... 333/206
5226909 9/1993 (JP) .
5283908 10/1993 (JP) .
6-204708 * 7/1994 (JP) ..... 333/206

OTHER PUBLICATIONS

Patent Abstracts of Japan, vol. 17, No. 676 (E–1475), Dec. 13, 1993 & JP 05 226909.
Patent Abstracts of Japan, vol. 13, No. 366 (E–806), Aug. 15, 1989 & JP 01 123501.
Patents Abstracts of Japan, vol. 18, No. 69 (E–1502), Feb. 4, 1994 & JP 05 283908.
European Search Report dated May 21, 1999.

* cited by examiner

*Primary Examiner*—Benny Lee
*Assistant Examiner*—Barbara Summons
(74) *Attorney, Agent, or Firm*—Ostrolenk, Faber, Gerb & Soffen, LLP

(57) ABSTRACT

A dielectric filter (10, 20) is provided with resonator holes 11*a* and 11*b*, and the resonator holes 11*a* and 11*b* have large-sectional area portions 12*a* and 12*b* and small-sectional area portions 13*a* and 13*b*, respectively. On the step portions 14*a* and 14*b* between the large-sectional area portions 12*a* and 12*b* and the small-sectional area portions 13*a* and 13*b*, grooves 15*a* and 15*b* or protruding portions 16*a* and 16*b* substantially surround the small-sectional area portions 13*a* and 13*b*, respectively. Inner conductors 23*a* and 23*b* formed on the inner surfaces of the resonator holes 11*a* and 11*b* are directly connected to input and output electrodes 22*a* and 22*b* formed on outer surfaces of a dielectric block 1.

24 Claims, 8 Drawing Sheets

DIELECTRIC FILTER HAVING AT LEAST ONE STEPPED RESONATOR HOLE WITH A RECESSED OR PROTRUDING PORTION, THE STEPPED RESONATOR HOLE EXTENDING FROM A MOUNTING SURFACE

BACKGROUND OF THE INVENTION

1. Technical Field of the Invention

The present invention relates to a dielectric filter, a dielectric duplexer, and a communication apparatus using the same.

2. Related Art of the Invention

There has been known a dielectric filter used for a mobile communication unit, which has a single dielectric block in which a plurality of resonator holes are provided. The resonator holes have large-diameter hole sections and small-diameter hole sections mechanically connected to each other, and also have step portions between the large-diameter hole sections and the small-diameter hole sections. Inner conductors are formed on the inner surfaces of the resonator holes, and an outer conductor is formed on almost all outer surfaces of the block except for one opening end face among both end faces where the resonator holes have openings. The inner conductors are electrically disconnected (open) at one opening end face (open-circuited end face) and electrically short-circuited (connected) at the other opening end face (short-circuited end face). A pair of input and output electrodes are formed on outer surfaces of the dielectric block without being connected to the outer conductor.

The center frequency of such a dielectric filter depends on the conductive-path length of the inner conductors from the open-circuited end face to the short-circuited end face. The length of the inner conductors is set to $\lambda/4$, where $\lambda$ indicates the wavelength at the center frequency. The center frequency of the dielectric filter becomes lower as the conductive-path length increases, and the center frequency becomes higher as the conductive-path decreases. Therefore, to make the dielectric filter compact by reducing the size in the axial direction (the direction from the open-circuited end face to the short-circuited end face) of the resonator holes without changing the center frequency, it is necessary to increase the ratio of the diameter of the large-diameter hole sections to that of the small-diameter hole sections to make the conductive-path length of the inner conductors equal to that in the filter before being made compact.

Since the distance between the axes of adjacent resonator holes, which specifies the degree of coupling in the dielectric filter, is set to a certain length, however, the diameter of the large-diameter hole sections is limited. On the other hand, it is difficult to extremely reduce the diameter of the small-diameter hole sections in terms of the forming technologies of the dielectric filter.

In addition, since the conventional dielectric filter has a low impedance when viewed from the input and output electrodes, the filter needs to be connected to an external circuit through a capacitor or other elements. Therefore, a space required for installing a capacitor needs to be held and the capacitor needs to be soldered to the dielectric filter, which is complicated.

SUMMERY OF THE INVENTION

Accordingly, it is an object of the present invention to provide a dielectric filter and a dielectric duplexer which can be easily made compact and which can be connected to an external circuit without using a capacitor or other elements, and a communication apparatus provided with the dielectric filter or the dielectric duplexer.

The invention provides dielectric filter or a dielectric duplexer, comprising: a dielectric block having two opposite end surfaces and an outer surface; resonator holes in said dielectric block extending between said end surfaces; inner conductors on inner surfaces of said resonator holes; an outer conductor on said an outer surface of said dielectric block; input and output electrodes on the outer surfaces of said dielectric block; at least one of said resonator holes comprising a large-sectional area portion and a small-sectional area portion connected to each other and providing a step portion therebetween; and at least one of a recessed portion and a protruding portion being provided at said step portion.

With the above configuration, since the recessed portions or the protruding portions are provided on the step portions, the conductive paths of the inner conductors at the step portions pass along the surfaces of the recessed portions or the protruding portions and become longer by that length. Therefore, when the dielectric filter and the dielectric duplexer are reduced in size in the axial direction of the resonator holes, the conductive-path lengths of the inner conductors do not change.

Another advantage of the above dielectric filter or dielectric duplexer is that the inner conductors on inner surfaces of said resonator holes may be directly connected to said input and output electrodes.

When an inner conductor is directly connected to an input and output electrode, external coupling Qe usually becomes too strong. However, due to large capacitances generated between the inner conductors and the outer conductor, and between the input and output electrodes and the outer conductor by providing the recessed portions or the protruding portions on the step portions, the impedance viewed from the input and output electrodes becomes low, external coupling Qe becomes weak, and it becomes unnecessary to use a capacitor or other elements, which are conventionally required for connection to an external circuit. Thus, it becomes unnecessary to keep a space required for installing a capacitor and to perform complicated soldering between the capacitor and the dielectric filter or the dielectric duplexer.

In the above dielectric duplexer, another advantage is that the shape of at least one first resonator hole constituting the transmission filter may differ from that of at least one second resonator hole constituting the receiving filter. Or, at least the transmission filter may comprise at least two first resonator holes having different shapes from each other, or at least the receiving filter comprise at least two second resonator holes having different shapes from each other.

With the above configuration, the degree of freedom in designing the dielectric duplexer is increased.

The present invention further provides a communication apparatus comprising the above described dielectric filter or dielectric duplexer.

The apparatus can be made compact by the use of the above dielectric filter or the above dielectric duplexer having a short axial length of resonator holes. In addition, a capacitor or other elements which are conventionally required for connection to a dielectric filter or a dielectric duplexer can be omitted.

PREFERRED EMBODIMENTS OF THE PRESENT INVENTION

Figure 1:
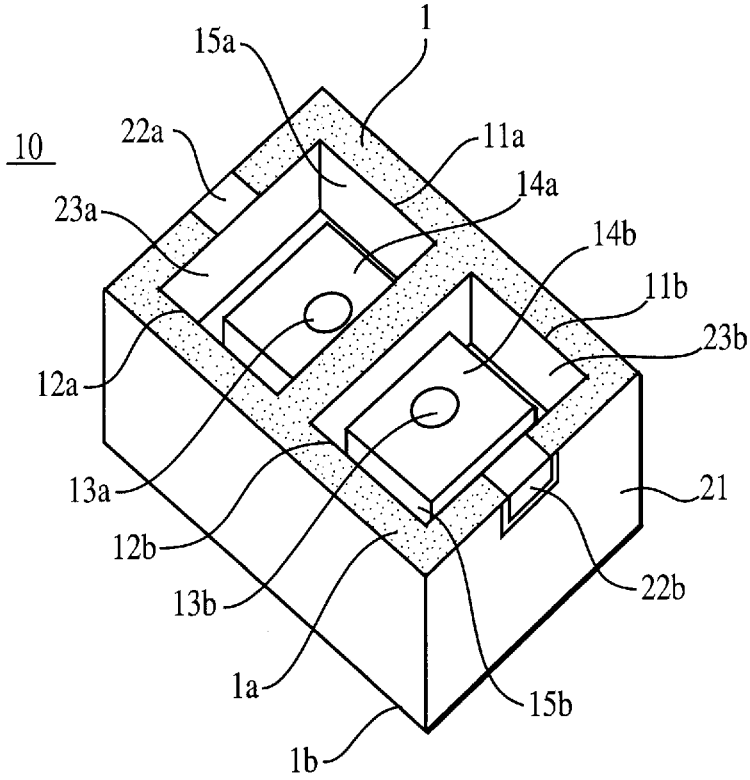
FIG. 1 is a perspective view of a dielectric filter according to a first embodiment of the present invention.

Other features and advantages of the present invention will become apparent from the following description of preferred embodiments of the invention which refers to the accompanying drawings, wherein like reference numerals indicate like elements to avoid duplicative description.

[First Embodiment, FIG. 1 to FIG. 8]

Figure 2:
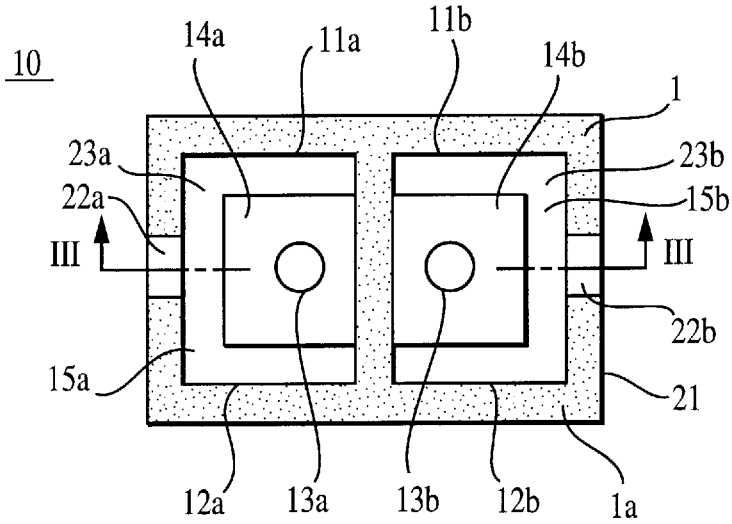
FIG. 2 is a plan view of the dielectric filter shown in FIG. 1.
Figure 3:
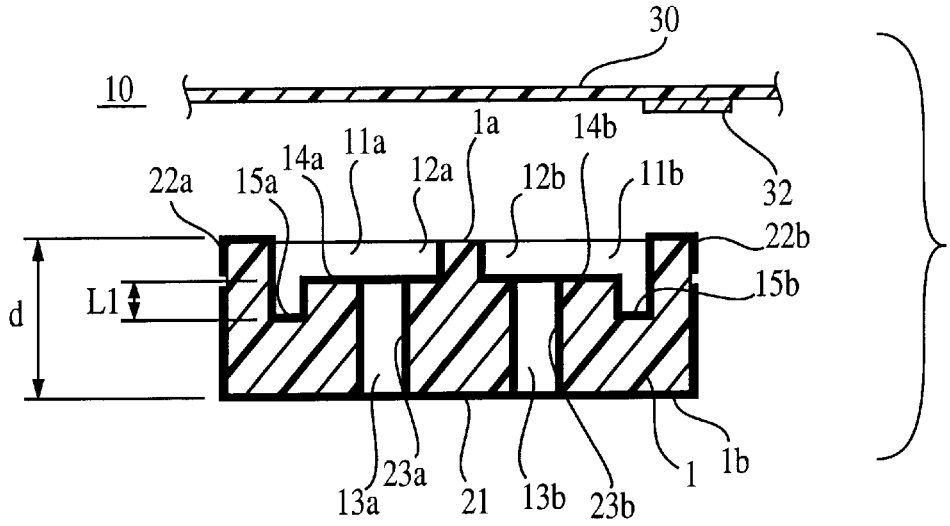
FIG. 3 is a cross section taken on line III—III shown in FIG. 2, including circuit board 30.

As shown in FIG. 1 to FIG. 3, a dielectric filter 10 has two resonator holes 11*a* and 11*b* passing through opposing surfaces 1*a* and 1*b* of a dielectric block 1. The resonator holes 11*a* and 11*b* have large and rectangular cross-sectional hole portions 12*a* and 12*b* as large-sectional area portions, and small and circular cross-sectional hole portions 13*a* and 13*b* as small-sectional area portions mechanically connected to the large-sectional area portions 12*a* and 12*b*, respectively. The axes of the large-sectional area portions 12*a* and 12*b* shift from those of the small-sectional area portions 13*a* and 13*b*. The degree of coupling in the dielectric filter 10 is determined by the distance of the axes of the adjacent large-sectional area portions 12*a* and 12*b*, the distance between the axes of the small-sectional area portions 13*a* and 13*b*, and other factors.

On step portions 14*a* and 14*b* at the boundaries of the large-sectional area portions 12*a* and 12*b* and the small-sectional area portions 13*a* and 13*b*, grooves 15*a* and 15*b* are formed at a certain distance apart from the small-sectional area portions 13*a* and 13*b*. In other words, the grooves 15*a* and 15*b* are formed such that they surround about three-fourths the small-sectional area portions 13*a* and 13*b* along the inner surfaces of the large-sectional area portions 12*a* and 12*b* except the adjacent inner surfaces of the large-sectional area portions 12*a* and 12*b*.

On the outer surfaces of the dielectric block 1, an outer conductor 21 and a pair of input and output electrodes 22*a* and 22*b* are formed. On the inner surfaces of the resonator holes 11*a* and 11*b*, inner conductors 23*a* and 23*b* are formed. The outer conductor 21 is formed on the outer surfaces of the dielectric block 1 except for the portions where the input and output electrodes 22*a* and 22*b* are formed and the opening end face 1*a* (hereinafter called an open-circuited end face 1*a*) of the large-sectional area portions 12*a* and 12*b*. The pair of input and output electrodes 22*a* and 22*b* is formed without electrically connecting to the outer conductor 21 with a gap from the outer conductor 21. The input and output electrodes 22*a* and 22*b* are directly connected to the inner conductors 23*a* and 23*b*.

The inner conductors 23*a* and 23*b* are electrically open to (separated from) the outer conductor 21 at the open-circuited end face 1*a* and are connected to the input and output electrodes 22*a* and 22*b*, and are electrically short-circuited (connected) to the outer conductor 21 at the opening end face 1*b* (hereinafter called a short-circuited end face 1*b*) of the small-sectional area portions 13*a* and 13*b*.

Since the step portions 14*a* and 14*b* are provided with the grooves 15*a* and 15*b*, the conductive paths of the inner conductors 23*a* and 23*b* from the opening end face 1*a* to the input and output electrodes 22*a* and 22*b* are longer than those in a conventional dielectric filter, which has no grooves, by twice the length L1 of the side walls of the grooves 15*a* and 15*b*. The center frequency of the dielectric filter 10 decreases as the conductive-path lengths of the inner conductors 23*a* and 23*b* increase, and the center frequency increases as the conductive-path lengths are reduced. Therefore, with the same center frequency, the dielectric filter 10 can have a shorter axial length "d" of the resonator holes 11*a* and 11*b* than the conventional dielectric filter.

The input and output electrode 22*a* is directly connected to the inner conductor 23*a*. In the conventional dielectric filter, when an inner conductor is directly connected to an input and output electrode, the filter has too strong external coupling Qe. In the dielectric filter 10 according to the first embodiment, however, large capacitances are generated between the inner conductor 23*a* and the outer conductor 21, and between the input and output electrode 22*a* and the outer conductor 21 due to the groove 15*a* provided for the step portion 14*a*, and the impedance viewed from the input and output electrode 22*a* is reduced. On the other hand, since the external coupling Qe of the dielectric filter 10, which indicates a good degree of connection matching between the external circuit and the inner conductor 23*a*, is proportional to the impedance, the external coupling Qe becomes weak. This means the degree of external coupling is strong. Therefore, to connect an external circuit to the inner conductor 23*a*, a capacitor or other elements which are conventionally required for connection to an external circuit is not necessarily needed.

Figure 4:
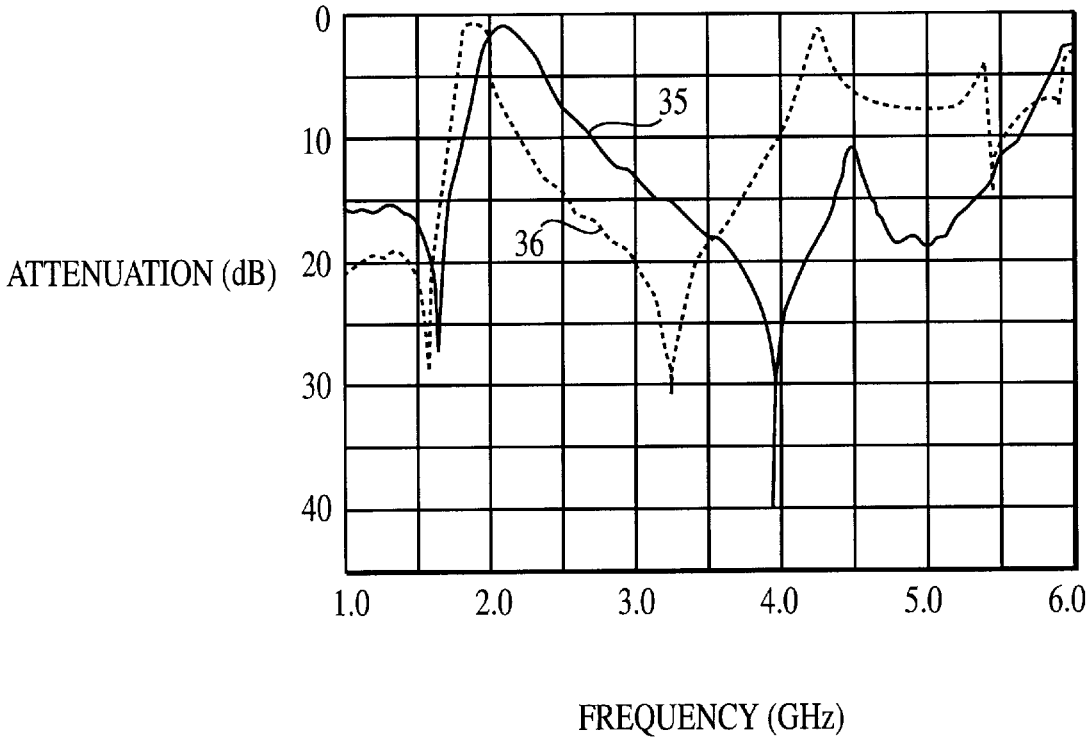
FIG. 4 is a graph indicating the spurious characteristic of the dielectric filter shown in FIG. 1.

In the same way, the input and output electrode 22*b* is directly connected to the inner conductor 23*b*. Due to large capacitances generated between the inner conductor 23*b* and the outer conductor 21, and between the input and output electrode 22*b* and the outer conductor 21, the impedance viewed from the input and output electrode 22*b* is reduced. Therefore, an external circuit can be connected to the dielectric filter 10 without the use of a capacitor or other elements. It is unnecessary to prepare a space for installing a capacitor and to perform complicated soldering between the capacitor and the dielectric filter. Since the input and output electrodes 22*a* and 22*b* are directly connected to the inner conductors 23*a* and 23*b*, a spurious resonance is reduced at a blocking area of the dielectric filter 10. This means that the frequency characteristics of the dielectric filter 10 are improved. FIG. 4 is a graph indicating a measured relationship between attenuation and frequency of the dielectric filter 10 according to the first embodiment shown in FIG. 1 to FIG. 3 (see a solid line 35). For comparison, the relationship between attenuation and frequency of a conventional dielectric filter is also shown (see a dotted line 36). Whereas the conventional dielectric filter has large spurious resonances at a frequency range of 4.0 to 5.4 GHz, which is a blocking band, the dielectric filter 10 has a slight spurious resonance at 4.5 GHz.

To mount the dielectric filter 10 on a printed circuit board, the open-circuited end face 1*a* can be used as a mounting surface. A leakage of an electromagnetic field is reduced and interference with other circuit components is prevented. As seen in FIG. 3, in an exploded view, a circuit board 30 is disposed adjacent to the dielectric filter 10 with an input/output electrode 11*b* of the filter being connectable to an external circuit 32 on the circuit board.

Figure 5:
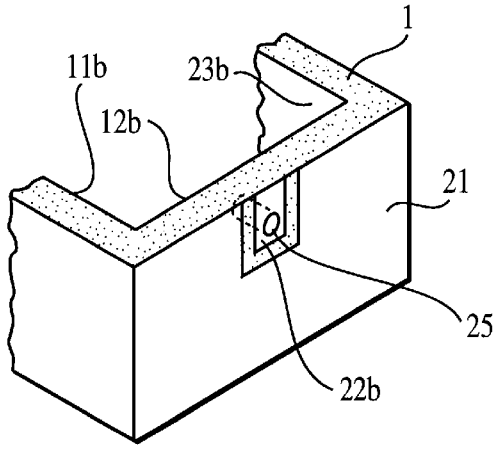
FIG. 5 is a perspective view of a modification of an input and output electrode of the dielectric filter shown in FIG. 1.
Figure 6:
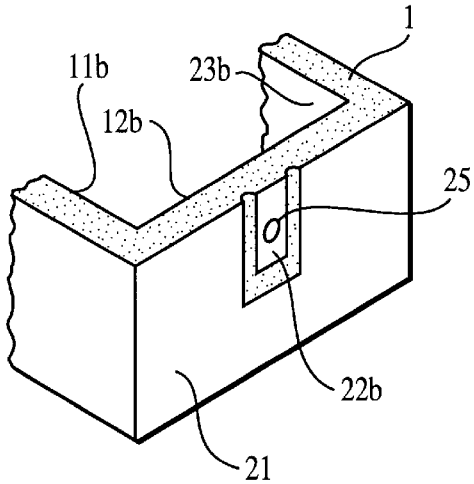
FIG. 6 is a perspective view of another modification of an input and output electrode of the dielectric filter shown in FIG. 1.

The connections between the input and output electrodes 22*a* and 22*b* and the inner conductors 23*a* and 23*b* can be modified in various ways. As shown in FIG. 5, for example, they may be connected through a through hole 25. The input and output electrodes 22*a* and 22*b* can be formed in various ways. As shown in FIG. 6, for example, the input and output electrodes 22*a* and 22*b* may be formed such that the outer conductor 21 is formed on the outer surfaces of the dielectric block 1 and then a certain portion around the through hole 25 is removed from the outer conductor 21 by a router.

Figure 7:
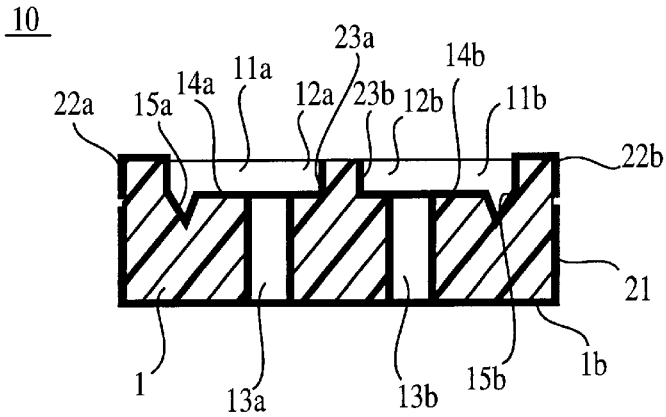
FIG. 7 is a cross section of a modification of the grooves of the dielectric filter shown in FIG. 1.

The transverse cross-sectional shape of the grooves 15*a* and 15*b* may be a reverse triangle as shown in FIG. 7, or a curve. This flexibility increases the degree of freedom in designing the dielectric filter 10.

Figure 8:
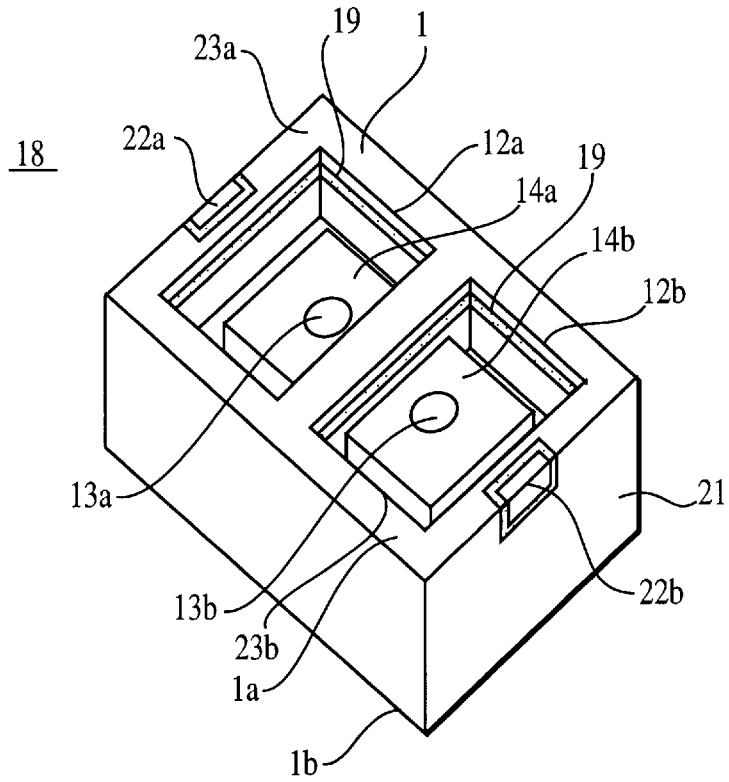
FIG. 8 is a perspective view of a dielectric filter according to a second embodiment of the present invention.

[Second Embodiment, FIG. 8]

As shown in FIG. 8, a dielectric filter 18 according to a second embodiment has the same configuration as the dielectric filter 10 according to the first embodiment, except for an outer conductor 21, inner conductors 23*a* and 23*b*, and input and output electrodes 22*a* and 22*b*. The outer conductor 21 is formed almost all outer surfaces of a dielectric block 1. The pair of input and output electrodes 22*a* and 22*b* are formed on outer surfaces of the dielectric block 1 without electrically connecting to the outer conductor 21 with a gap from the outer conductor 21. The input and output electrodes 22*a* and 22*b* are connected to an external circuit through a capacitor or other elements as required.

The inner conductors 23*a* and 23*b* are formed on almost all inner surfaces of resonator holes 11*a* and 11*b*. Gaps 19 are provided between the inner conductors 23*a* and 23*b* and the outer conductor 21 extending to the opening sections of large-sectional area portions 12*a* and 12*b*. The opening surface 1*a* of the large-sectional area portions 12*a* and 12*b* where the gaps 19 are formed serves as an open-circuited end face and the opening surface 1*b* of small-sectional area portions 13*a* and 13*b* serves as a short-circuited end face. The dielectric filter 18 configured as described above has the same advantages and operations as the dielectric filter 10 according to the first embodiment.

Figure 9:
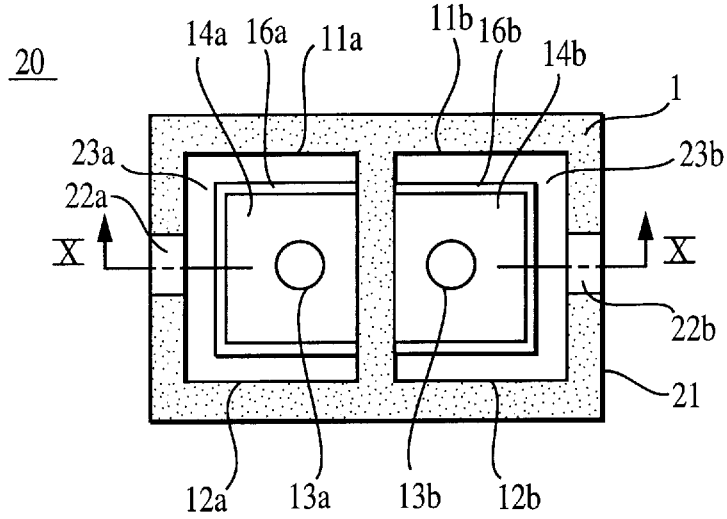
FIG. 9 is a plan view of a dielectric filter according to a third embodiment of the present invention.
Figure 10:
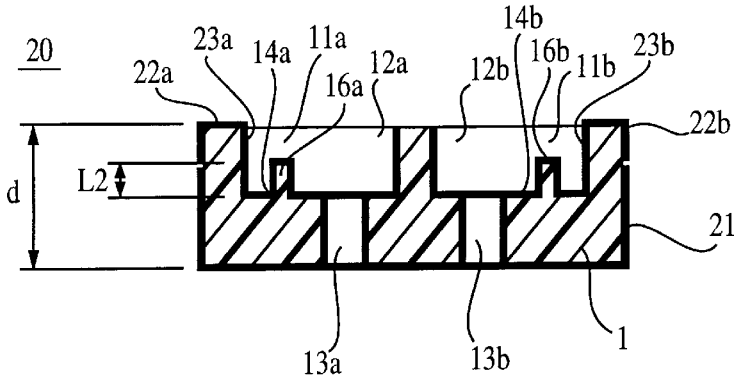
FIG. 10 is a cross section taken on line X—X shown in FIG. 9.

[Third Embodiment, FIG. 9 and FIG. 10]

As shown in FIG. 9 and FIG. 10, in a dielectric filter 20, protruding portions 16*a* and 16*b* are formed on step portions 14*a* and 14*b* in resonator holes 11*a* and 11*b* with a certain distance from small-sectional area portions 13*a* and 13*b*. The protruding portions 16*a* and 16*b* are formed such that they surround about three-fourths the small-sectional area portions 13*a* and 13*b* with the adjacent inner surfaces of large-sectional area portions 12*a* and 12*b* being left.

In the dielectric filter 20 configured as described above, since the protruding portions 16*a* and 16*b* are formed on the step portions 14*a* and 14*b*, the conductive-path lengths of the inner conductors 23*a* and 23*b* become longer than those in a conventional dielectric filter having no protruding portions by twice the length L2 of the side walls of the protruding portions 16*a* and 16*b*. Therefore, with the same center frequency, the dielectric filter 20 can have a shorter axial length "d" of the resonator holes 11*a* and 11*b* than the conventional dielectric filter, and thereby the dielectric filter 20 can be made compact.

[Fourth, Fifth, and Sixth Embodiments, FIG. 11 to FIG. 15]

Figure 11:
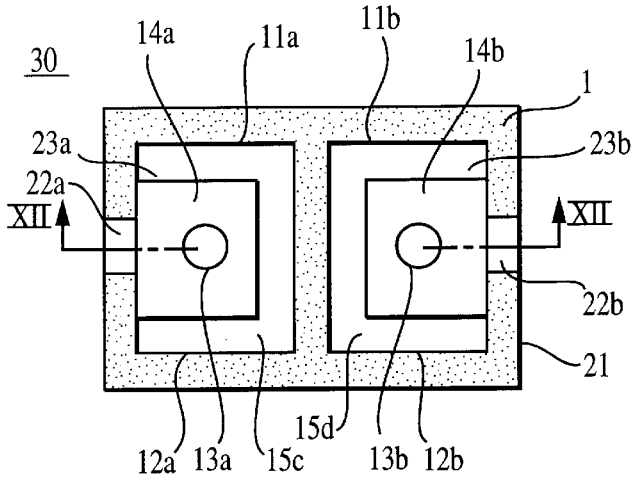
FIG. 11 is a plan view of a dielectric filter according to a fourth embodiment of the present invention.
Figure 12:
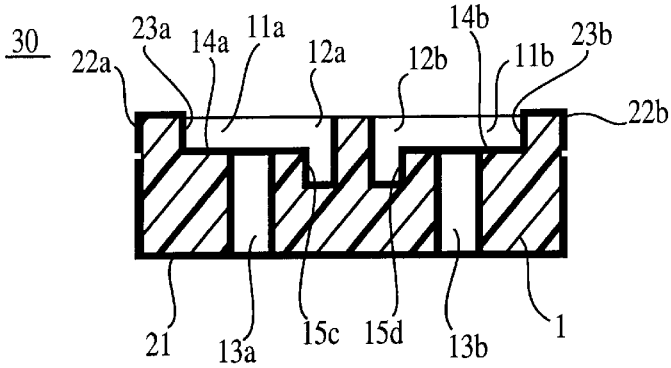
FIG. 12 is a cross section taken on line XII—XII shown in FIG. 11.

As shown in FIG. 11 and FIG. 12, a dielectric filter 30 according to a fourth embodiment has the same configuration as the dielectric filter 10 according to the first embodiment, except for grooves 15*c* and 15*d*. The grooves 15*c* and 15*d* are formed such that they surround about three fourths small-sectional area portions 13*a* and 13*b* along inner surfaces of large-sectional area portions 12*a* and 12*b* except the inner surfaces of the large-sectional area portions 12*a* and 12*b* where input and output electrodes 22*a* and 22*b* are formed. In the dielectric filter 30 configured as described above, the axial length "d" of the resonator holes 11*a* and 11*b* can be made shorter than in the conventional dielectric filter. In addition, a coupling capacitance between the resonator holes 11*a* and 11*b* becomes large and the degree of coupling in the dielectric filter 30 can be increased.

Figure 13:
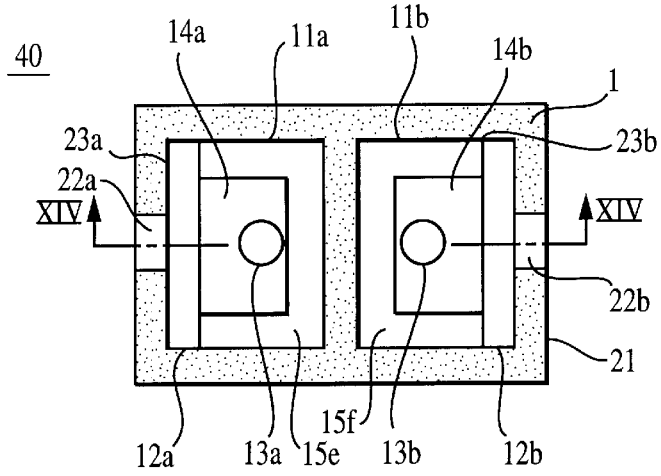
FIG. 13 is a plan view of a dielectric filter according to a fifth embodiment of the present invention.
Figure 14:
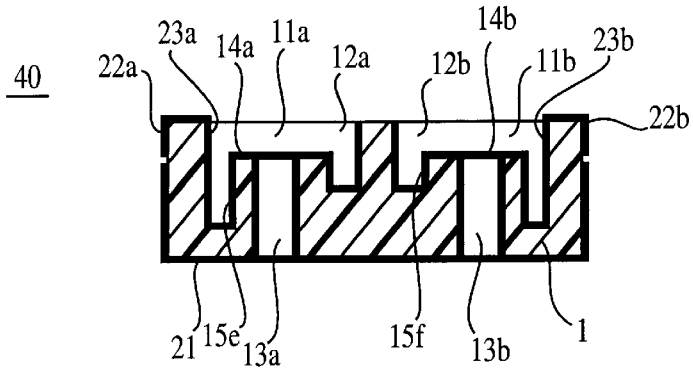
FIG. 14 is a cross section taken on line XIV—XIV shown in FIG. 13.

As shown in FIG. 13 and FIG. 14, a dielectric filter 40 according to a fifth embodiment has the same configuration as the dielectric filter 10 according to the first embodiment, except for grooves 15*e* and 15*f*. The grooves 15*e* and 15*f* are formed such that they completely surround small-sectional area portions 13*a* and 13*b* along the inner surfaces of large-sectional area portions 12*a* and 12*b*. The depth of the grooves 15*e* and 15*f* at the sides close to the input and output electrodes 22*a* and 22*b* is set greater than that of the other portions of the grooves 15*e* and 15*f*. Therefore, the frequency can further be reduced and the axial length of the resonator holes 11*a* and 11*b* can be further reduced.

Figure 15:
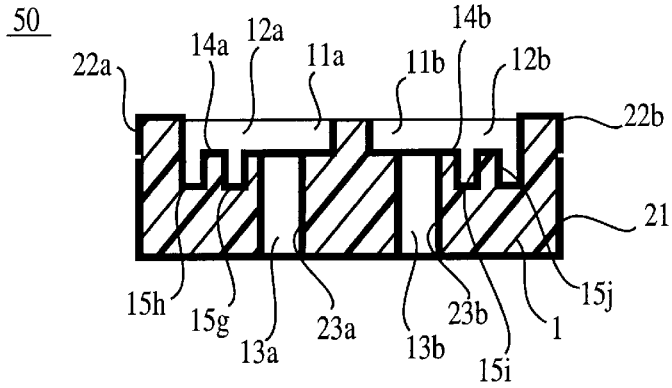
FIG. 15 is a cross section of a dielectric filter according to a sixth embodiment of the present invention.

As shown in FIG. 15, a dielectric filter 50 according to a sixth embodiment has the same configuration as the dielectric filter 10 according to the first embodiment, except for grooves 15*g*, 15*h*, 15*i*, and 15*j*. The grooves 15*g* and 15*h* are formed such that they surround twofold about three-fourths a small-sectional area portion 13*a* except for the inner surface of a large-sectional area portion 12*a* close to a large-sectional area portion 12*b* with the groove 15*g* placed inside and the groove 15*h* placed outside. In the same way, the grooves 15*i* and 15*j* are formed such that they surround twofold about three-fourths a small cross-section portion 13*b* except for the inner surface of the large-sectional area portion 12*b* close to the large-sectional area portion 12*a* with the groove 15*i* placed inside and the groove 15*j* placed outside. Therefore, the degree of freedom in designing the dielectric filter 50 is increased.

Figure 16:
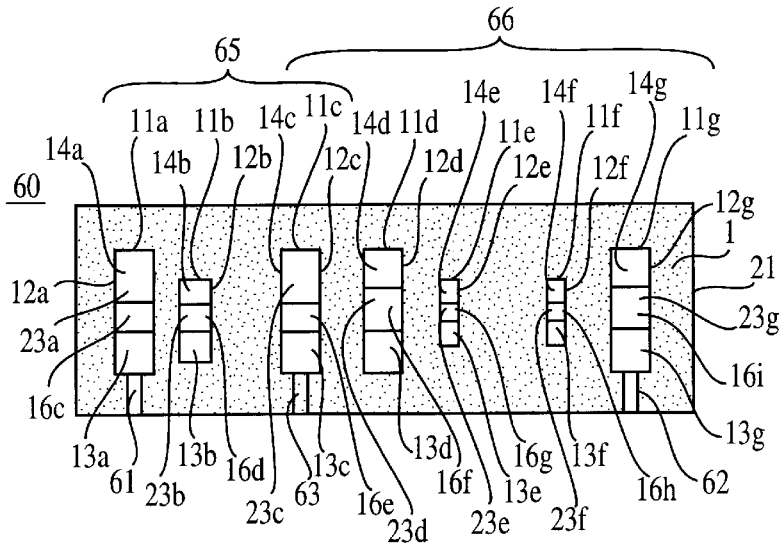
FIG. 16 is a plan of a dielectric duplexer according to a seventh embodiment of the present invention.
Figure 17:
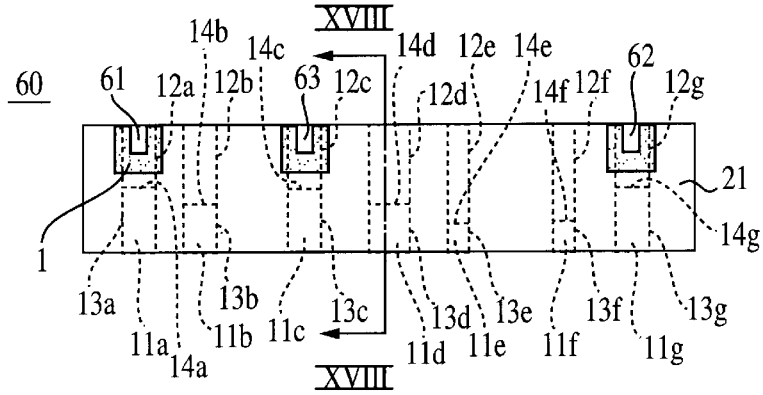
FIG. 17 is an elevation of the dielectric filter shown in FIG. 16.
Figure 18:
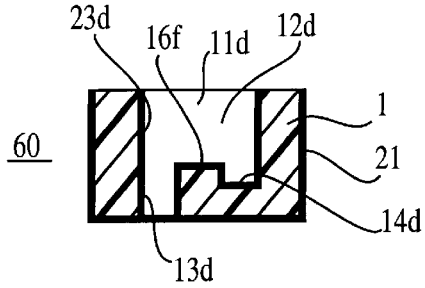
FIG. 18 is a cross section taken on line XVIII—XVIII shown in FIG. 17.

[Seventh Embodiment, FIG. 16 to FIG. 18]

As shown in FIG. 16 to FIG. 18, a dielectric duplexer 60 formed of seven resonators 11*a* to 11*g* made on one dielectric block 1, according to a seventh embodiment, will be described below. In the seventh embodiment, the dielectric duplexer has protruding portions on step portions at the boundaries between large-sectional area portions and small-sectional area portions of resonator holes. It is needless to say that the dielectric duplexer may have recessed portions instead of the protruding portions.

Resonator holes 11*a* to 11*g* have large and rectangular cross-sectional hole portions 12*a* to 12*g* as large-sectional area portions and small and circular cross-sectional hole portions 13*a* to 13*g* as small-sectional area portions mechanically connected to the large-sectional area portions 12*a* to 12*g*. On step portions 14*a* to 14*g* at the boundaries between the large-sectional area portions 12*a* to 12*g* and the small-sectional area portions 13*a* to 13*g*, protruding portions 16*c* to 16*i* are formed in contact with sides of the small-sectional area portions 13*a* to 13*g*. The sizes of the resonator holes 11*a* to 11*g* and the sizes and heights of the protruding portions 16*c* to 16*i* are independently specified to obtain the desired electric characteristics of the duplexer 60. In other words, the resonator holes 11*a*, 11*c*, 11*d*, and 11*g* are set to have large sizes, the resonator holes 11*e* and 11*f* are set to have small sizes, and the resonator holes 11*b* is set to have an intermediate size. In addition, the distances between the resonator holes 11*a* to 11*g* are also independently specified according to the specifications.

Three resonator holes 11*a* to 11*c* disposed at almost the left-hand side of the duplexer 60 are electromagnetically coupled with each other to form a transmission resonant circuit (transmission filter) 65. In the same way, the resonator hole 11*c* and four resonator holes 11*d* to 11*g* disposed at almost the right-hand side of the duplexer 60 are electromagnetically coupled with each other to form a receiving resonant circuit (receiving filter) 66.

On the outer surfaces of the dielectric block 1, an outer conductor 21, a transmission electrode 61, a receiving electrode 62, and an antenna electrode 63 are formed. On the inner surfaces of the resonator holes 11*a* to 11*g*, inner conductors 23*a* to 23*g* are formed. The inner conductor 23*a* is directly connected to the transmission electrode 61, the inner conductor 23*c* is directly connected to the antenna electrode 63, and the inner conductor 23*g* is directly connected to the receiving electrode 62. In this way, the duplexer 60 having a common antenna electrode 63, which has a shorter axial length of the resonator holes 11*a* to 11*g* than a conventional duplexer, is obtained.

In the duplexer 60, the shape of the resonator holes 11*a* to 11*c* constituting the transmission filter 65 differs from that of the resonator holes 11*e* and 11*f* constituting the receiving filter 66. The transmission filter 65 is formed of the resonator holes 11*a* and 11*c*, and the resonator hole 11*b*, which has a different shape from that of the resonator holes 11*a* and 11*c*. The receiving filter 66 is formed of the resonator holes 11*c* and 11*g*, and the resonator holes 11*e* and 11*f*, which have a different shape from that of the resonator holes 11*d* and 11*g*. With this, the degree of freedom in designing the dielectric duplexer 60 is increased.

Figure 19:
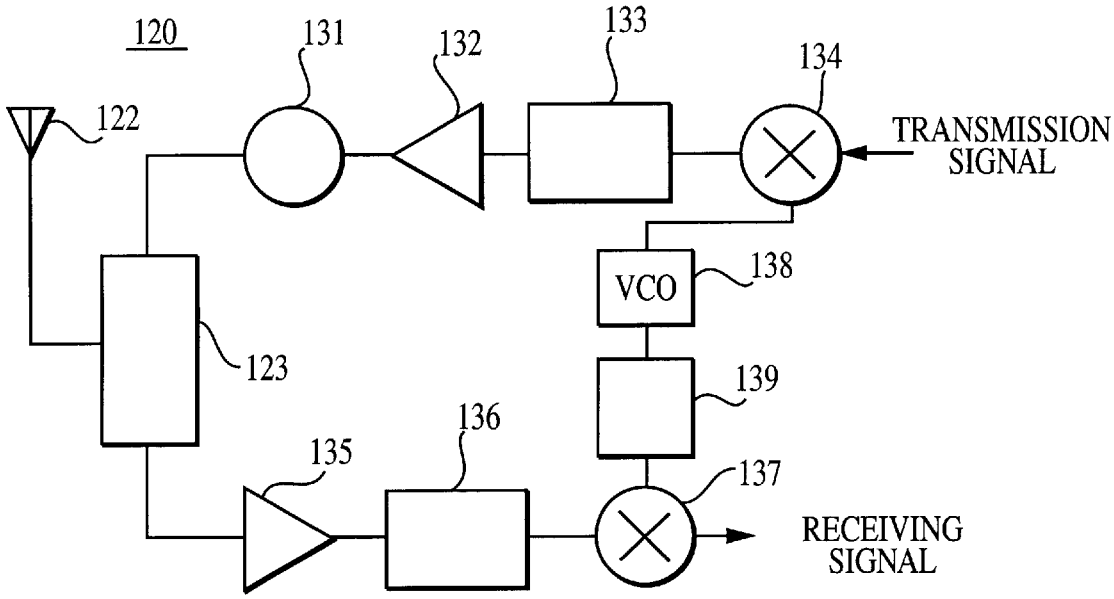
FIG. 19 is an electric block diagram of a communication apparatus according to an eight embodiment of the present invention.

[Eight Embodiment, FIG. 19]

A communication apparatus according to an eigth embodiment of the present invention will be described below by taking a portable telephone as an example.

FIG. 19 is a block diagram of an RF electric circuit of a portable telephone 120. In FIG. 19, there are shown an antenna element 122, an antenna multiplexing filter (duplexer) 123, a transmission isolator 131, a transmission amplifier 132, a transmission interstage bandpass filter 133, a transmission mixer 134, a receiving amplifier 135, a receiving interstage bandpass filter 136, a receiving mixer 137, a voltage-controlled oscillator (VCO) 138, and a local bandpass filter 139.

As the antenna multiplexing filter (duplexer) 123, the duplexer 60 according to the seventh embodiment, for example, can be used. As the transmission and receiving interstage bandpass filters 133 and 136, and the local bandpass filter 139, the dielectric filters 10, 18, 20, 30, 40, and 50 according to the first to sixth embodiments, for example, can be used.

[Other Embodiments]

A dielectric filter, a dielectric duplexer, or a communication apparatus according to the present invention is not limited to those in the above embodiments. The dielectric filter, the dielectric duplexer, and the communication apparatus can be modified in various ways within the scope of the invention.

Figure 20:
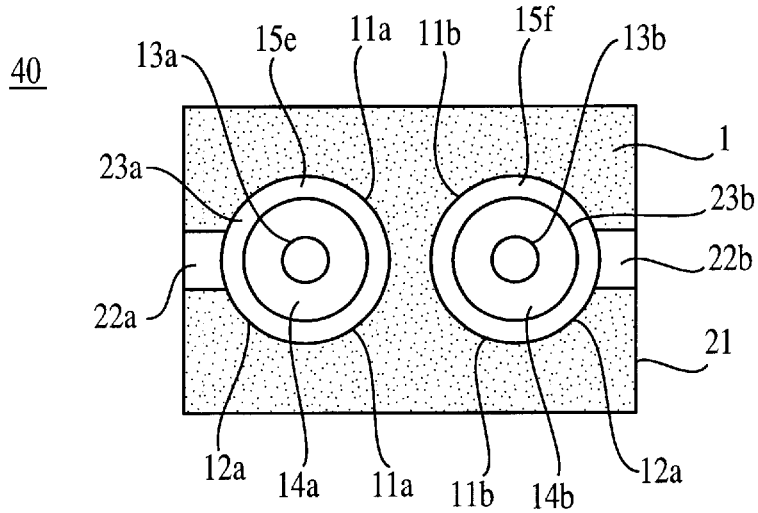
FIG. 20 is a plan view of a dielectric filter according to a ninth embodiment of the present invention.

The large-sectional area portions and the small-sectional area portions in a dielectric filter or a dielectric duplexer can have any cross-sectional shapes. As shown in FIG. 20, for example, the dielectric filter 40 according to the fifth embodiment may be configured such that the large-sectional area portions 12*a* and 12*b* have circular cross sections and the grooves 15*e* and 15*f* are made like rings. Other shapes such as an ellipse shape is also applicable.

Dielectric filters of the present invention include a filter formed in one dielectric block, and a plurality of filters formed in one dielectric block. A recessed portion and a protruding portion may be combined appropriately in a dielectric filter or a dielectric duplexer. This increases the degree of freedom in designing the dielectric filter or the dielectric duplexer. A duplexer and a multiplexer can easily be manufactured.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric filter, comprising:

a dielectric block having two opposite end surfaces and an outer surface;

resonator holes in said dielectric block extending between said end surfaces;

inner conductors on inner surfaces of said resonator holes;

an outer conductor on said outer surface of said dielectric block;

input and output electrodes on the outer surface of said dielectric block;

at least one of said resonator holes comprising a large-sectional area portion and a small-sectional area portion connected to each other and having a step portion therebetween; and at least one of a recessed portion and a protruding portion being provided at said step portion;

a respective one of said inner conductors in said at least one resonator hole being electrically separated at an open-circuit end thereof from said outer conductor, one of said end surfaces of said dielectric block that is nearer to said open-circuit end of said inner conductor being a mounting surface of the dielectric block, wherein said input and output electrodes are disposed at said mounting surface so as to be connectable to an external circuit at said mounting surface;

said resonator holes extending away from said mounting surface, and said large-sectional area portion being disposed at said mounting surface;

wherein said at least one of a recessed portion and a protruding portion is a protruding portion.

2. The dielectric filter according to claim 1, further comprising an external circuit disposed substantially along said mounting surface and electrically connected to said input and output electrodes.

3. The dielectric filter according to claim 1, wherein said resonator holes extend substantially perpendicularly away from said mounting surface.

4. A dielectric filter, comprising:

a dielectric block having two opposite end surfaces and an outer surface;

resonator holes in said dielectric block extending between said end surfaces;

inner conductors on inner surfaces of said resonator holes;

an outer conductor on said outer surface of said dielectric block;

input and output electrodes on the outer surface of said dielectric block;

at least one of said resonator holes comprising a large-sectional area portion and a small-sectional area portion connected to each other and having a step portion therebetween; and at least one of a recessed portion and a protruding portion being provided at said step portion;

said inner conductor in said at least one hole being electrically separated at an open-circuit end thereof from said outer conductor, one of said end surfaces of said dielectric block that is nearer to said open-circuit end of said inner conductor being a mounting surface of the dielectric block, wherein said input and output electrodes are disposed adjacent to said mounting surface and thereby adjacent to an external circuit disposed at said mounting surface, said resonator holes extending away from said mounting surface;

wherein said inner conductor on said inner surface of said at least one of said resonator holes is directly connected to a respective one of said input and output electrodes; and wherein said at least one of a recessed portion and a protruding portion is a protruding portion.

5. A dielectric duplexer comprising:

a dielectric block having two opposite end surfaces and an outer surface;

at least one first resonator hole constituting a transmission filter in said dielectric block extending between said end surfaces;

at least one second resonator hole constituting a receiving filter in said dielectric block extending between said end surfaces;

inner conductors on inner surfaces of said first and second resonator holes;

an outer conductor on said outer surface of said dielectric block;

input and output electrodes on the outer surface of said dielectric block;

at least one of said first and second resonator holes comprising a large-sectional area portion and a small-sectional area portion connected to each other and having a step portion therebetween; and at least one of a recessed portion and a protruding portion being provided at said step portion;

a respective one of said inner conductors in said at least one of said first and second resonator holes being electrically separated at an open-circuit end thereof from said outer conductor, one of said end surfaces of said dielectric block that is nearer to said open-circuit end of said inner conductor being a mounting surface of the dielectric block, wherein said input and output electrodes are disposed at said mounting surface so as to be connectable to an external circuit at said mounting surface;

said resonator holes extending away from said mounting surface, and said large-sectional area portion being disposed at said mounting surface;

wherein said at least one of a recessed portion and a protruding portion is a protruding portion.

6. The dielectric duplexer according to claim 5, wherein said resonator holes extend substantially perpendicularly away from said mounting surface.

7. The dielectric duplexer according to claim 5, wherein the receiving filter comprises at least two second resonator holes having different shapes from each other.

8. The dielectric duplexer according to claim 7, wherein said inner conductor on said inner surface of said at least one of said first and second resonator holes is directly connected to a respective one of said input and output electrodes.

9. The dielectric duplexer according to claim 5, further comprising an external circuit disposed substantially along said mounting surface and electrically connected to said input and output electrodes.

10. The dielectric duplexer according to claim 5, wherein the shape of said at least one first resonator hole constituting the transmission filter differs from that of said at least one second resonator hole constituting the receiving filter.

11. The dielectric duplexer according to claim 10, wherein said inner conductor on said inner surface of said at least one of said first and second resonator holes is directly connected to a respective one of said input and output electrodes.

12. The dielectric duplexer according to claim 5, wherein said inner conductor on said inner surface of said at least one of said first and second resonator holes is directly connected to a respective one of said input and output electrodes.

13. The dielectric-duplexer according to claim 5, wherein the transmission filter comprises at least two first resonator holes having different shapes from each other.

14. The dielectric duplexer according to claim 13, wherein the receiving filter comprises at least two second resonator holes having different shapes from each other.

15. The dielectric duplexer according to claim 14, wherein said inner conductor on said inner surface of said at least one of said first and second resonator holes is directly connected to a respective one of said input and output electrodes.

16. The dielectric duplexer according to claim 13, wherein said inner conductor on said inner surface of said at least one of said first and second resonator holes is directly connected to a respective one of said input and output electrodes.

17. A communication apparatus comprising:

a transmission circuit;

a receiving circuit; and a dielectric filter, said dielectric filter comprising:

a dielectric block having two opposite end surfaces and an outer surface;

resonator holes in said dielectric block extending between said end surfaces;

inner conductors on inner surfaces of said resonator holes;

an outer conductor on said outer surface of said dielectric block;

input and output electrodes on the outer surface of said dielectric block;

at least one of said resonator holes comprising a large-sectional area portion and a small-sectional area portion connected to each other and having a step portion therebetween; and at least one of a recessed portion and a protruding portion being provided at said step portion;

a respective one of said inner conductors in said at least one resonator hole being electrically separated at an open-circuit end thereof from said outer conductor, one of said end surfaces of said dielectric block that is nearer to said open-circuit end of said inner conductor being a mounting surface of the dielectric block, wherein said input and output electrodes are disposed at said mounting surface so as to be connectable to an external circuit at said mounting surface;

said resonator holes extending away from said mounting surface, said large-sectional area portion being disposed at said mounting surface, and at least one of said input and output electrodes on said dielectric filter being connected to at least one of said transmission circuit and said receiving circuit;

wherein said at least one of a recessed portion and a protruding portion is a protruding portion.

18. A communication apparatus according to claim 17, wherein said inner conductor on said inner surface of said at least one of said resonator holes is directly connected to a respective one of said input and output electrodes.

19. A communication apparatus comprising:

a transmission circuit;

a receiving circuit; and a dielectric duplexer comprising:

a dielectric block having two opposite end surfaces and an outer surface;

at least one first resonator hole constituting a transmission filter in said dielectric block extending between said end surfaces;

at least one second resonator hole constituting a receiving filter in said dielectric block extending between said end surfaces;

inner conductors on inner surfaces of said first and second resonator holes;

an outer conductor on said outer surface of said dielectric block;

input and output electrodes on the outer surface of said dielectric block;

at least one of said first and second resonator holes comprising a large-sectional area portion and a small-sectional area portion connected to each other and having a step portion therebetween; and at least one of a recessed portion and a protruding portion being provided at said step portion;

a respective one of said inner conductors in said at least one of said first and second resonator holes being electrically separated at an open-circuit end thereof from said outer conductor, one of said end surfaces of said dielectric block that is nearer to said open-circuit end of said inner conductor being a mounting surface of the dielectric block, wherein said input and output electrodes are disposed at said mounting surface so as to be connectable to an external circuit at said mounting surface;

said resonator holes extending away from said mounting surface, said large-sectional area portion being disposed at said mounting surface, and said transmission circuit and said receiving circuit being connected to respective ones of said input and output electrodes on said dielectric block;

wherein said at least one of a recessed portion and a protruding portion is a protruding portion.

20. A communication apparatus according to claim 19, wherein the transmission filter comprises at least two first resonator holes having different shapes from each other.

21. A communication apparatus according to claim 20, wherein the receiving filter comprises at least two second resonator holes having different shapes from each other.

22. A communication apparatus according to claim 19, wherein the shape of said at least one first resonator hole constituting the transmission filter differs from that of said at least one second resonator hole constituting the receiving filter.

23. A dielectric filter, comprising:

a dielectric block having two opposite end surfaces and an outer surface;

resonator holes in said dielectric block extending between said end surfaces;

inner conductors on inner surfaces of said resonator holes;

an outer conductor on said outer surface of said dielectric block;

input/output electrodes on the outer surface of said dielectric block;

at least one of said resonator holes comprising a large-sectional area portion and a small-sectional area portion connected to each other and having a step portion therebetween; and two recessed portions having different respective depths are provided at said step portion.

24. The dielectric filter according to claim 23, wherein one of said two recessed portions is closer to one of said input/output electrodes and has a greater depth than the other of said two recessed portions.

* * * * *